US008162188B2

(12) United States Patent
Schelhaas et al.

(10) Patent No.: US 8,162,188 B2
(45) Date of Patent: Apr. 24, 2012

(54) AID FOR TAKING OFF STOCKINGS

(75) Inventors: Ealbertus Willem Schelhaas, Heiloo (NL); Eelco Schouten, Amsterdam (NL)

(73) Assignee: Steven Bernardus Antonius Westerbos (NL)

( * ) Notice: Subject to any disclaimer, the term of this patent is extended or adjusted under 35 U.S.C. 154(b) by 904 days.

(21) Appl. No.: 12/096,022

(22) PCT Filed: Dec. 8, 2006

(86) PCT No.: PCT/NL2006/000629

§ 371 (c)(1),
(2), (4) Date: Jun. 3, 2008

(87) PCT Pub. No.: WO2007/067050

PCT Pub. Date: Jun. 14, 2007

(65) Prior Publication Data

US 2008/0308587 A1 Dec. 18, 2008

(30) Foreign Application Priority Data

Dec. 9, 2005 (NL) ..... 1030634

(51) Int. Cl.
*A47G 25/80* (2006.01)

(52) U.S. Cl. ..... 223/111

(58) Field of Classification Search ..... 223/111–119
See application file for complete search history.

(56) References Cited

U.S. PATENT DOCUMENTS

2007/0145086 A1* 6/2007 Perez ..... 223/111
2008/0308587 A1* 12/2008 Schelhaas et al. ..... 223/111

* cited by examiner

*Primary Examiner* — Shaun R Hurley
*Assistant Examiner* — Andrew Sutton
(74) *Attorney, Agent, or Firm* — Ryan A. Schneider, Esq.; Troutman Sanders LLP

(57) ABSTRACT

A stocking take-off assistance device suitable as aid for taking of stockings, particularly elastic support stockings, the stocking take-off assistance device including at least one substantially annular inner device suitable to be arranged around a leg and to receive the turned upper edge of a stocking, a substantially annular outer device matching the annular inner device, suitable to be arranged around the leg and around the inner device such that an upper edge of a stocking folded around the annular inner device can be clamped between the annular inner device and the annular outer device. The annular inner device is not completely closed but extends over an angle (α) smaller than 360°. Likewise, the annular outer device is not completely closed but extends over an angle (β) smaller than 360°.

15 Claims, 6 Drawing Sheets

AID FOR TAKING OFF STOCKINGS

BENEFIT CLAIMS

This application is a US National Stage of International Application No. PCT/NL2006/000629, filed 8 Dec. 2006, which claims the benefit of NL 1030634, filed 9 Dec. 2005.

The invention relates to an aid for taking-off stockings. Herewith, in the context of the present invention, a device is meant which is intended to be used as an aid for facilitating taking-off of stockings, particularly elastic support stockings.

It is generally known that taking-off of elastic support stockings is difficult for the user. One has to exert quite some force, and in doing so one has to bring the hands to the location of the foot to grip the stocking, and these are two aspects which are difficult for a large part of the people having support stockings.

The Dutch patent application NL-90.00361, laid open on 2 Sep. 1991, gives an elaborate description of the problems in the case of putting on and taking off support stockings. This description is still valid, and is considered to be incorporated by reference in the present invention, so that it is not necessary to repeat this description. The said Dutch patent application NL-90.00361 proposes a device suitable to be used as an aid in the case of putting on support stockings as well as in the case of taking off support stockings. This known device comprises an annular clamp consisting of two parts, comprising an inner ring and an outer ring. The inner ring has a substantially circular cross-section; during use, an end of the stocking is folded around this inner ring. The outer ring has a U-shaped cross-section, the legs of this U being directed towards the inside. The outer ring is arranged around the inner ring, so that the inner ring comes to lay between the legs of the U, the dimensions of the inner ring and outer ring being matched to each other in such a way that the end of the stocking folded around the inner ring is clamped in between the inner ring and outer ring.

This known aid offers the advance that the user does not need any more to grab the stocking himself, but the user can now handle the outer ring, which is much easier. In order to facilitate this handling further, the outer ring may be provided with brackets, grips, handles or the like.

Although this known aid functions well in practice, it has some disadvantages. When a stocking is to be taken off, one must first arrange the inner ring around the leg. To this end, one must shift the inner ring over the leg starting from the foot, and arranging the ring over the foot means that the user must be able to reach with his hands to his foot, which may be a problem for less-valid people. In order to solve this problem, the publication describes that the inner ring consists of two parts hinging with respect to each other so that the inner ring can be shifted over the leg from the side, but this requires the necessity of applying a hinged part.

For the same reason, the publication describes that the outer ring consists of two parts hinging with respect to each other, wherein furthermore a latch is present to keep the hinged outer ring closed.

A further disadvantage concerns the operation of applying the outer ring around the inner ring. Because of the U-shaped cross section of the outer ring, the hinged open outer ring must be placed radially adjacent the inner ring, in one plane with the inner ring, and then must be shifted over the inner ring with a movement directed radially towards the leg. In practice, this movement appears difficult to control for less-valid people, in which context one should realise that the outer ring is relatively heavy due to the grips attached thereto.

Subsequently, one must immediately close and secure the latch mechanism in order to prevent the outer ring from falling off the inner ring.

Further, if the rings are circular, the diameter of the rigid ring assembly must be adapted to the largest cross dimension that is to be passed, which is the distance between instep and heel. Consequently, the diameter of the ring assembling is relatively large, and this means that it costs relatively much force to arrange the end of the stocking around the inner ring. In order to reduce this problem, it is possible that the rings have an elliptical shape, the largest diameter being adapted to the distance between instep and heel, while the smallest diameter is adapted to the width of the leg. However, a disadvantage then is that the outer ring fits around the inner ring in only one way, so that it is no longer possible to rotate the outer ring tangentially with respect to the inner ring. If one has not positioned the inner ring correctly with respect to the leg, and has folded the end of the stocking around the inner ring, it is no longer possible to rotate the inner ring tangentially with respect to the leg, which means therefore that the outer ring with the grips will be crooked with respect to the leg.

The present invention aims to provide a further development of the known aid which lacks the said disadvantages, or wherein said disadvantages are at least reduced.

The present invention is based on the insight that the said disadvantages are associated with the fact that the inner ring and outer ring of the said publication, at least during use, are completely closed, and is further based on the insight that, for a good functioning of the aid, it is not necessary that the inner ring and outer ring are completely closed. Based on these insights, the present invention provides an aid with an inner ring and an outer ring which extend over less than 360°; more particularly, these rings have a perimeter dimension in the range of about 215° to about 290°, an perimeter dimension in the order of about 255° being preferred.

Thus, the inner ring can be implemented as a rigid one part ring, thus not as two hinged halves, while it is further no longer necessary that the inner ring is shifted over the leg starting from the foot. The inner ring can, somewhat resiliently, be shifted over the leg with a movement directed radially with respect to the leg.

The inner ring then has two ends, which are located at a certain distance from each other, typically in the order of 5 to 15 cm. On passing the foot, the instep can extend in the opening defined by this distance between the two ring ends till outside the perimeter of the ring. Thus, the diameter of the ring does not need any more to be adapted to the distance instep-heel. It is now possible that the rings are implemented circularly with a diameter smaller than the distance instep-heel, so that spanning the stocking end around the inner ring requires less force. Implementation in the shape of a circle in turn has an advantage that the inner ring and the outer ring can be shifted tangentially with respect to each other, so that a miss-positioning of the inner ring does not automatically need to lead to a miss-positioning of the outer ring.

In a further aspect of the present invention, the outer ring and inner ring have an inner contour and outer contour, respectively adapted to each other, which make it possible that the outer ring is arranged around the leg adjacent to the inner ring, and is then brought into contact with the inner ring via an axial displacement. This displacement can be executed relatively easily, and can even be executed relatively easily while one holds the outer ring at the grips or the like attached thereto. In this context, it is noted that the ring assembly of the present aid is primarily intended as aid for taking off stockings, so that the outer ring of the aid only needs to transfer to the inner ring a pushing force, directed towards the foot.

The said contours are such that the inner ring and outer ring are automatically centering with respect to each other (self-seeking).

In order to be also useable as pulling-on-aid, the outer ring is preferably provided with fixed brackets, around which the end of a stocking can be folded, such that the foot can be placed into the stocking. In this context, the inner ring thus has no function.

It is noted that European patent application 0.878.157 describes an aid for putting on and taking off stockings, which aid comprises two ring parts co-operating with each other, which can be arranged around a leg from the side, and which co-operate with each other for gripping the collar of a stocking. In that case, the two ring parts are attached to a scissor like bracket, so that the ring parts can only move transversely with respect to each other. Consequently, the ring parts can only extend over maximally 180°, and for providing a sufficient instep opening, the rings must be stretched according to the shape of halve an ellipse. When using this aid, it is a disadvantage that the ring parts are fixedly connected to the scissor-like bracket, which has two long stem-shaped grips, because on manoeuvring (applying and taking away) of the ring parts one is hindered by the length and the weight of the bracket. Furthermore, it is a disadvantage that, for providing sufficient clamping force, it is necessary to squeeze the two stem-shaped grips towards each other: thus, the use of this aid requires much force in the hands of the user, while the target group of this aid in practice just has less force in the hands. Further, it is inconvenient that the collar of the stocking must be arranged around the profiled outer service of the upper ring from the lower side.

U.S. Pat. No. 2,903,170 describes an aid for putting on stockings, which aid comprises two ring parts cooperating with each other, which can be arranged around a leg from the side, and which cooperate with each other for gripping the collar of a stocking. In this case, the two ring parts are attached to two respective bracket parts of a bracket, which bracket parts can be displaced longitudinally with respect to each other. The horseshoe-shaped ring parts extend over more than 180°, but here, too, the constant connection too the bracket is a disadvantage. The ring parts are not tapered. Here, too, it is a disadvantage that, for providing sufficient clamping force, it is necessary to squeeze the two stem-shaped grips towards each other, in this case with a longitudinal squeezing force. Further, it is a disadvantage that, because of the longitudinal displacement possibility, the bracket part connected to the lower ring must be provided with an end folded back over 180°, located within the plane of the lower ring, such that the rings because of this are extra large and applying the stockings around the lower ring is extra aggravated.

The Dutch patent application 93.00731 describes an aid for taking off stockings, which aid comprises two tapered rings cooperating with each other. In this case, it is a disadvantage that the rings extend over 360°, i.e. are completely closed, so that the rings must be shifted over the leg via the foot. Further, it is a disadvantage that the outer ring must be pulled be means of two cords and a pulley to be attached to a wall: this complicates the use, and elderly people and less valid people often lack the flexibility and force in their hands to handle the cords. Further, it is a disadvantage that the user must hold up his leg concerned in use, and that he must stabilise himself with his other leg and must brace himself against the pulling force, and the danger is present that he is pulled from his seat. Further, this aid requires an installation of parts to the wall, for which it is necessary to drill holes. Further, this aid is not mobile, i.e. the aid can only be used at the location where the parts are installed to the wall, and not in an other room or in an other house: more particularly, it is not or at least not easily possible to take along the aid when the user is visiting or goes on holiday, which means a serious restriction of the freedom of the user.

These and other aspects, features and advantages of the present invention will be further clarified by the following description with reference to the drawings, in which same reference numerals indicate same or similar parts, and in which.

Figure 2:
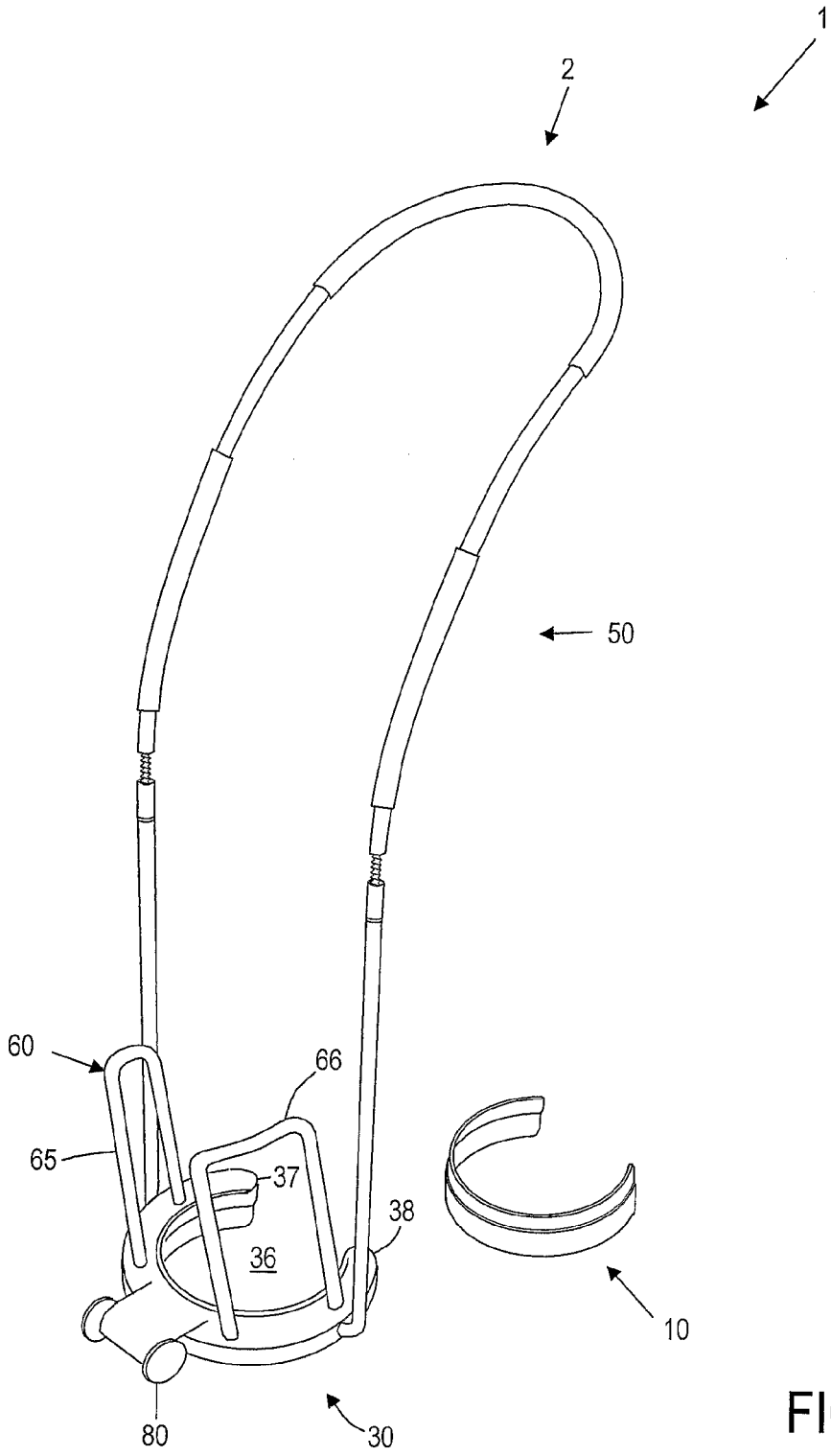
FIG. 2 shows a schematic perspective view of a second embodiment of a stocking take-off assistance device according to the present invention.
Figure 3:
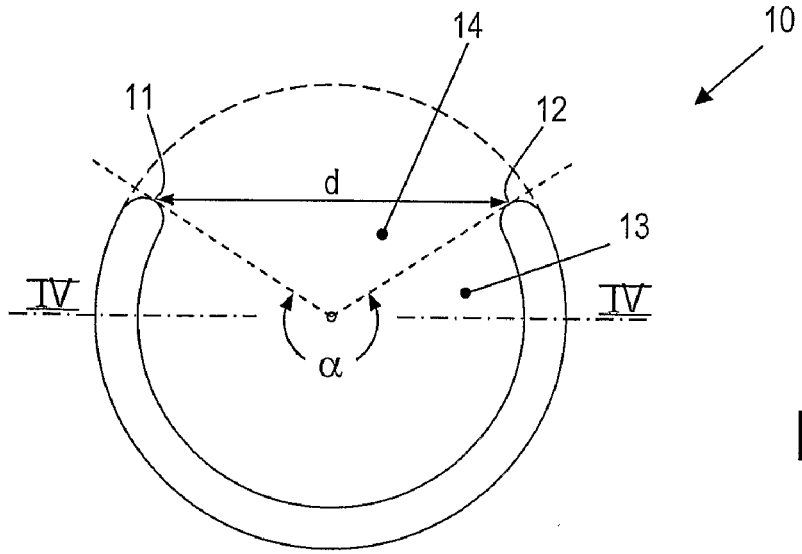
Figure 4:
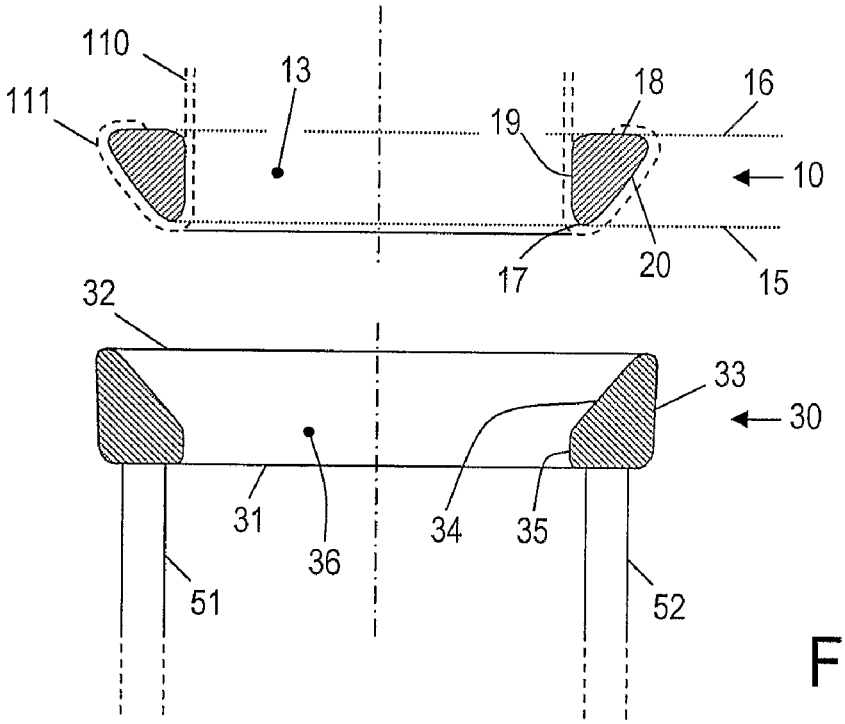
Figure 5A:
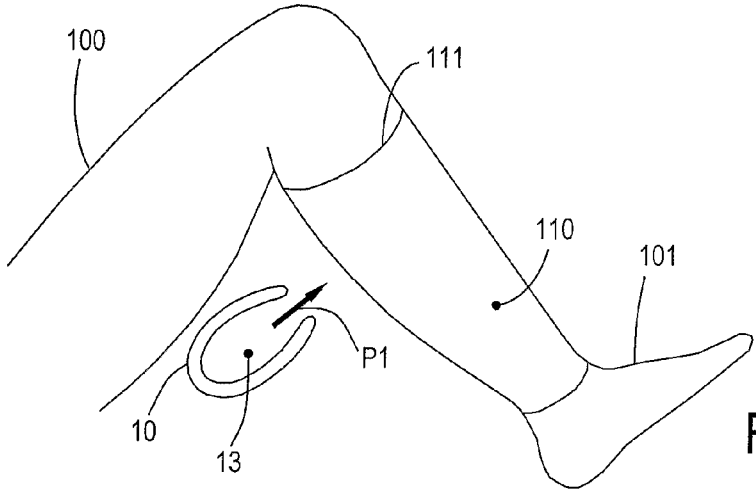
Figure 5B:
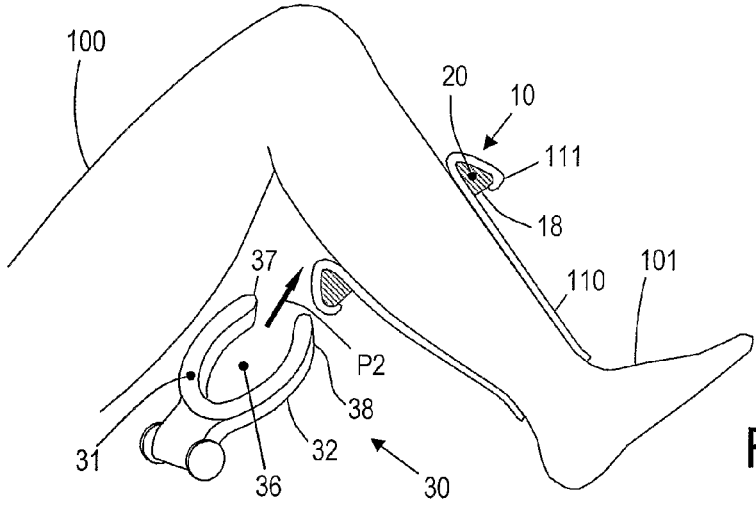
Figure 5C:
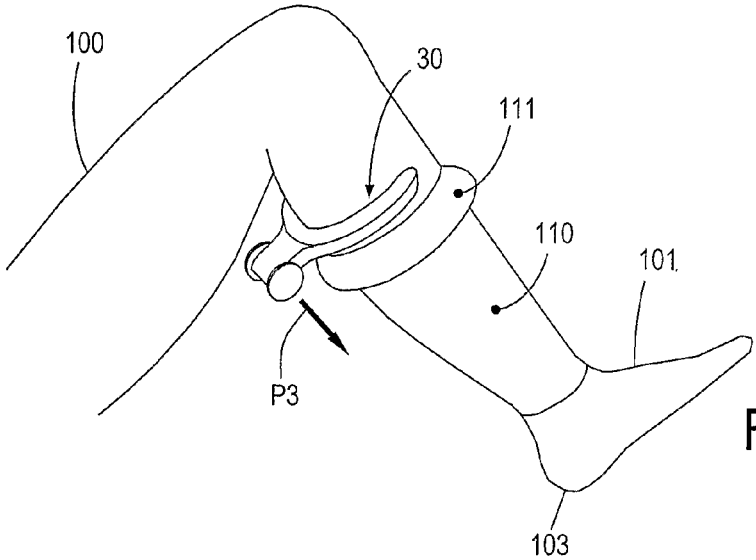
Figure 6:
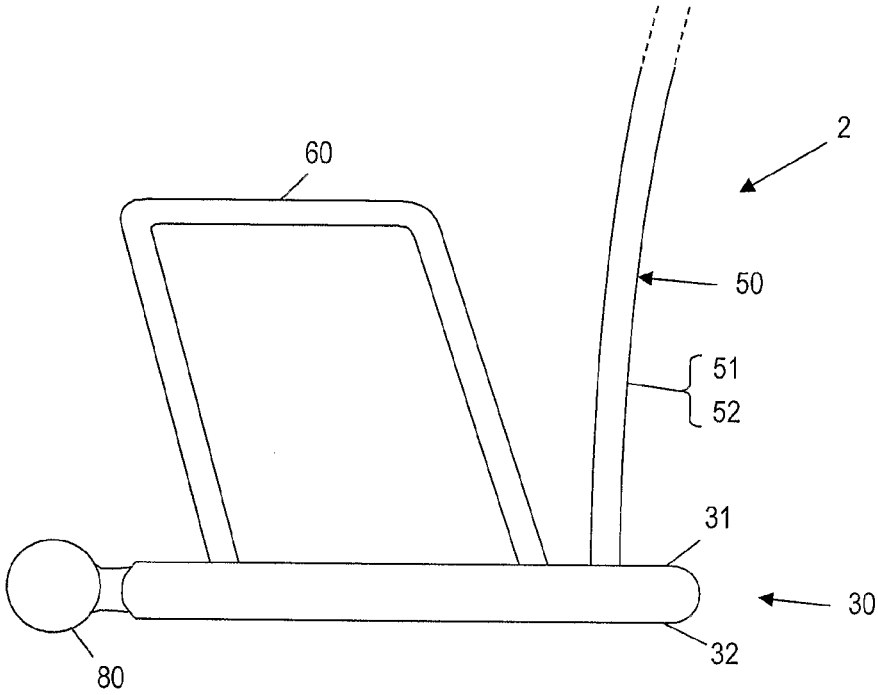
Figure 7A:
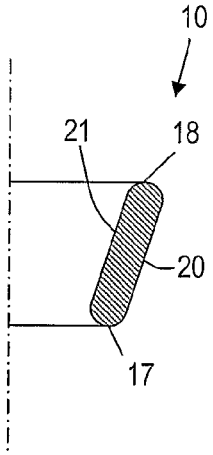
Figure 7B:
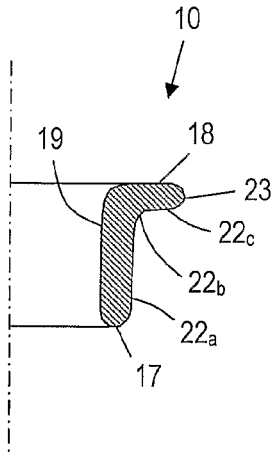
Figure 7C:
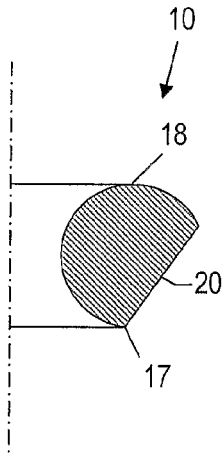
Figure 8:
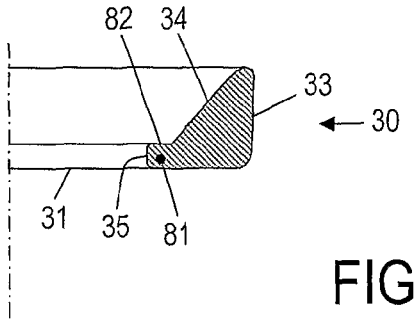
Figure 9:
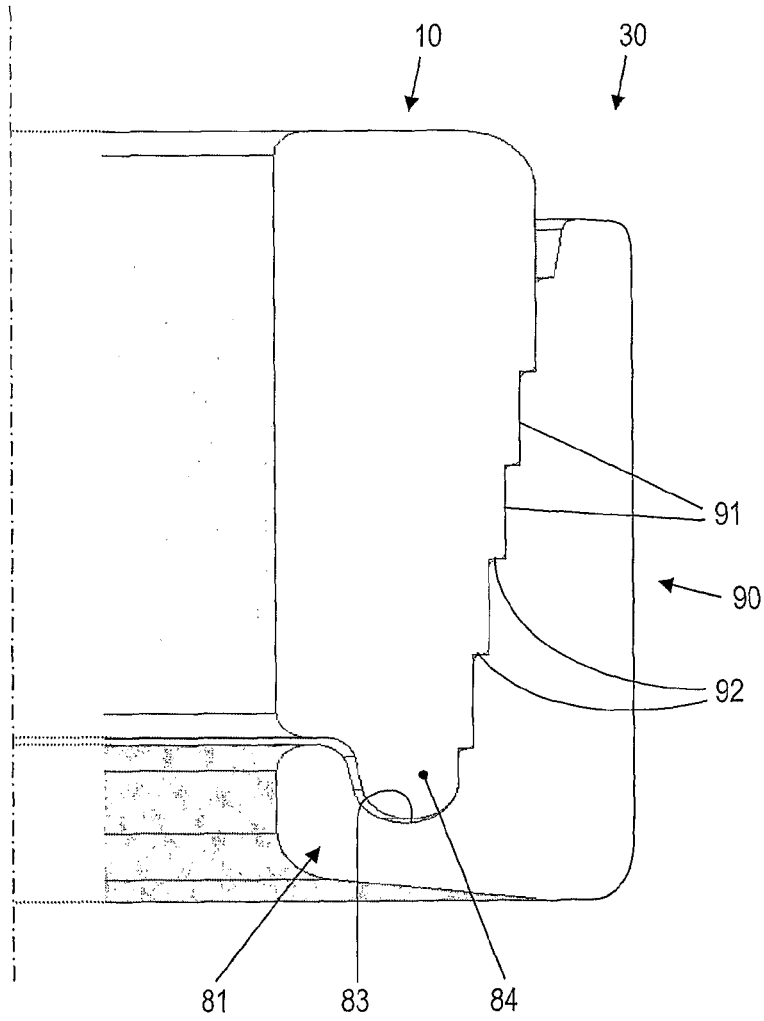

FIG. 3 schematically shows a top view of an inner ring of a stocking take-off assistance device according to the present invention;

FIG. 4 schematically shows a cross section according to the line IV-IV of a preferred embodiment off the inner ring and the outer ring of a stocking take-off assistance device according to the present invention;

FIGS. 5A-C schematically illustrate the use of the stocking take-off assistance device according to the present invention;

FIG. 6 schematically shows a side view of the outer ring assembly of the stocking take-off assistance device according to FIG. 2; and the FIGS. 7A-C show some variations for the shape of the cross section of the inner ring;

FIG. 8 shows a variation for the shape of the cross section of the outer ring;

and FIG. 9 is a figure comparable to FIG. 4 showing a preferred detail of the shape of the two rings.

Figure 1:
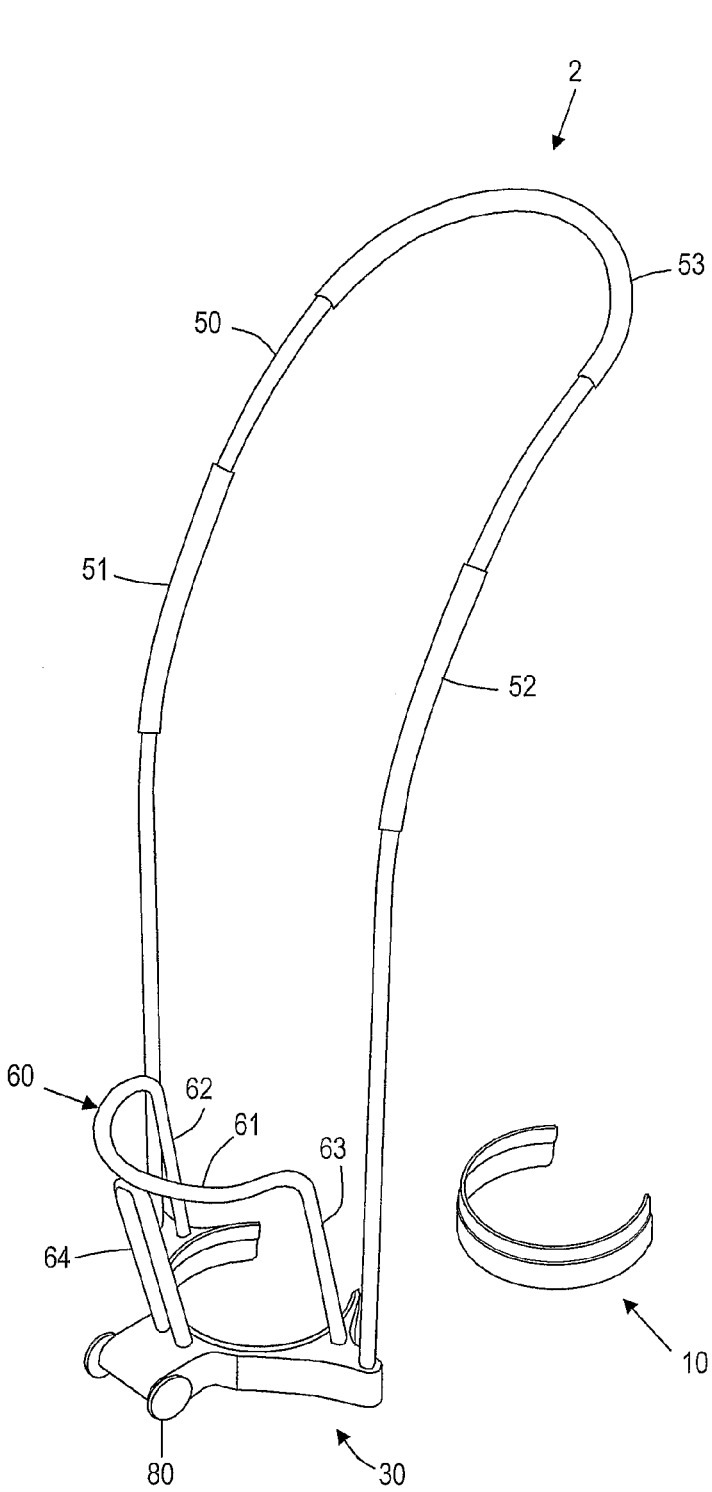
FIG. 1 shows a schematic perspective view of a first embodiment of a stocking take-off assistance device according to the present invention.

FIG. 1 schematically shows a perspective view of a first embodiment of a stocking take-off assistance device 1 according to the present invention. The assistance-device 1 comprises two parts to be coupled to each other, i.e. an inner ring 10 and an outer ring 30. As will be explained more elaborately later, a grip 50, a bracket 60 and a wheel assembly 80 are attached to the outer ring 30; this assembly will be indicated by the phrase outer ring assembly 2.

FIG. 2 shows a view comparable to FIG. 1 of an other embodiment of the outer ring assembly 2. In this other embodiment, particularly the bracket 60 is implemented in a different manner.

FIG. 3 schematically shows a top view of the inner ring 10. In the preferred embodiment, the inner ring 10 is circular, as shown, the inner ring 10 being not completely closed but extending over an angle $\alpha$ which in this embodiment is for instance equal to 230°. The annular size of the inner ring is not critical, but is preferably in the range of approximately 215° to approximately 290°; in a preferred embodiment, the circumferential size is in the order of about 255°. In any case $\alpha$ will be smaller than 360°.

Because the inner ring 10 is not closed, the inner ring has ends 11 and 12 which are located at a certain distance from each other. In a suitable embodiment, this distance d is approximately 5 to 15 cm, it being noted that the inner ring 10 may be implemented somewhat flexible and resilient so that this distance can be changed somewhat by the user. Further, in practice there will be embodiments in several sizes, dependent on the thickness of the legs of the user.

The inner ring 10 surrounds a space which will be indicated by the phrase "inner space 13", and the mutual distance d between the both ring ends 11 and 12 defines an excess opening 14 to this inner space 13.

In a comparable manner, also the outer ring 30 has a circular contour which is not closed but extends over an angle β which preferably is equal to the said angle α. Thus, also the outer ring 30 has an inner space 36 with an excess opening that is defined by the distance between the two ends 37, 38 of the ring. In any case, β will be smaller than 360° and, for the sake of stability preferably larger than 180°. Preferably, 215°≦β≦290° applies.

FIG. 4 schematically shows a cross section according to the line IV-IV of a possible embodiment of the inner ring 10, from the viewing point of the user, it is to say that the direction from hip to foot of the user is directed from downside to upside in the figure. From FIG. 4, it appears that the cross section of the inner ring 10 in this embodiment has a substantially triannular contour. The inner ring 10 has an axial length between two mutually parallel planes 15 and 16 directed radialy, wherein the lowest plane 15 in FIG. 4 will be indicated as "proximal plane" and wherein the opposite plane 16 is indicated as "distal plane". The proximal plane 15 defines a proximal end edge 17 of the inner ring 10, while the distal end plane 16 defines a distal end edge 18 of the inner ring. In the embodiment shown, the inner ring 10 has a substantially axially directed inner surface 19 and an obliquely directed outer surface 20, i.e. an outer surface located on a cone plane. The radial dimension of the inner ring 10 at its proximal end edge 17 is smaller than the radial dimension of the inner ring 10 at the distal end plane 16.

FIG. 6 schematically shows a side view of the embodiment of the outer ring assembly 2 according to FIG. 2. In the side view of FIG. 6, the outer ring 30 has an upper surface 31 and a lower surface 32. The grip 50 and the bracket 60 are located at the side of the upper surface 31; this is the surface which, during use, will be directed to the upper body of the user. The wheel assembly 80 is located at a central part of the outer ring 30. In the case of the embodiment of the FIGS. 1, 2 and 6, the grip 50 is implemented in the form of two bars 51, 52, which are mounted substantially perpendicularly to the upper surface 31, and which meet each other in a curve section 53. It can be seen in the side view of FIG. 6 that the bars 51 and 52 are curved, with the concave sides of the curve directed away from the wheel assembly 80, i.e. directed towards the said entrance opening.

FIGS. 1, 4 and 6 illustrate that the bars 51, 52 may end directly on the upper surface 31 of the outer ring 30. FIG. 2 illustrates that the bars 51, 52 may be bent inwards at their lower ends in order to engage the outer surface of the outer ring 30. This has the advantageous result that the mutual distance between the bars 51 and 52 can be somewhat larger, resulting in somewhat more space between the bracket 60 and the bars 51, 52. In the case of the embodiment illustrated in FIG. 1, this additional space is provided because the outer ring 30 is provided with mounting parts extending sidewards to the outside for the bars 51, 52.

FIGS. 5A to 5C schematically illustrate the use of the assistance device 1 according to the present invention. FIG. 5A schematically shows a leg 100 with a support stocking 110 arranged thereon. For removing this support stocking 110, the inner ring 10 is first arranged around the leg 100, close to the upper end 111 of the support stocking 110 such that the proximal end 17 is directed towards the upper body while the distal end 18 is directed to the foot 101. According to an important aspect of the present invention, this can be done by shifting the inner ring 10 over the leg by means of a radial displacement, indicated by the arrow P1, from the rear side to the front side of the leg. In doing so, the leg 100 with the support stocking 111 enters the inner space 13 of the inner ring 10, via the access opening 14 of this inner space 13.

In a next step, the upper end 111 of the support stocking 110 is folded around the inner ring 10, as shown in FIG. 5B; for sake of clarity, the support stocking 110 and the inner ring 10 are shown here in cross section. It appears clearly from this figure that the inner ring 10 is arranged such that the proximal end 17 is directed to the upper body while the distal end 18 is directed to the foot 101.

In a next step, the outer ring 30 is arranged around the leg 100, above the inner ring 10, the lower surface 32 being directed to the inner ring 10 and the upper surface 31 being directed to the upper body. Placement of the outer ring 30 can be done with a radial displacement, indicated by a second arrow P2, in which case the leg 100 passes between the free ends of the ring 30 in order to enter the inner space of the ring 30. In the embodiment shown, the outer ring 30 is displaced from the rear side of the leg 100 to the front, but it is also possible that the outer ring 30 is shifted around the leg from a different direction, for instance from the front side of the leg, after which the outer ring 30 is turned around its axis until the wheel assembly 80 is located at the rear side of the leg.

In FIG. 4, also a cross section of the outer ring 30 is schematically shown, in order to illustrate the cooperation between the outer ring 30 and inner ring 10 in the situation now achieved. In FIG. 4, the outer ring 30 is coaxially aligned with the inner ring 10, the lower surface 32 of the outer ring 30 being directed to the inner ring 10. Further, the ends of the bars 51 and 52 are schematically shown in FIG. 4, which are directed substantially perpendicular with respect to the upper surface 31 of the outer ring 30 directed away from the inner ring 10.

The outer ring 30 has an outer surface 33 of which the shape is not critical; in this example, this outer surface is directed substantially axially. The inner surface 34 of the outer ring 30, at least a part thereof, is directed obliquely, i.e. it is located on a cone plane, and is directed to the oblique outer surface 20 of the inner ring 10. The obliqueness of the oblique inner surface 34 of the outer ring 30, i.e. the top angle of the corresponding imaginary cone plane, corresponds to the top angle of the oblique outer surface 20 of the inner ring 10. In FIG. 4, the support stocking 110 and the upper end 111 of the support stocking 110 folded around the inner ring 10 are shown in dotted lines.

In a next step, the outer ring 30 is pressed on to the inner ring 10, according to an axial displacement directed towards to the foot 101, indicated by a third arrow P3 in FIG. 5C. Thus, the upper end 111 of the support stocking 110 is pinched between the oblique inner surface 34 of the outer ring 30 and the oblique outer surface 20 of the inner ring 10.

Because of the obliqueness of both said surfaces, it is not necessary that the user aims accurately with the outer ring: the outer ring 30 seeks its own position on the inner ring 10. Further, it is still possible to change the relative orientation of the outer ring 30 with respect to the leg 100 by a tangential rotation of the outer ring 30, thanks to the circular shape of the inner ring 10 and outer ring 30.

By now increasing the pressure force on the outer ring 30, the outer ring 30 presses the inner ring 10 in the direction of the foot 101, the upper end 111 of the stocking 110 being taken along. On passing the heel 103, the instep of the foot 101 can project through the access opening 14 out of the inner space 13 of the inner ring 10; the same applies in relation to the outer ring 30.

The central wheel assembly 80 is not essential, but it does offer advantages. Particularly, the central wheel assembly 80 can rest on a ground plane, without damaging this ground plane, such that the grip 50 and the rings 10, 30 operate as a lever which, on passing the heel 103, without one having to exert much force, automatically lifts the foot such that the ring assembly can pass below the heel without one having to do much effort for lifting the foot. Preferably, and as shown in FIGS. 1 and 2, the wheel assembly 80 has two wheels located at an axial distance with respect to each other, in order to increase the transverse stability of the assistance device 1, but as an alternative the wheel assembly 80 might also comprise a single wide wheel or roller.

The cross-section of the inner ring 10 shown in FIG. 4 is not essential; more particularly, the precise shape of the inner surface 19 is not critical. FIGS. 7A to 7C show some of the possible variations for the shape of the cross section of the inner ring 10. In the variation of FIG. 7A the inner ring 10 has the shape of an oblique strip, such that the cross section is a parallelogram, in which case the inner surface 21 will also be directed obliquely, parallel to the outer surface 20. It will be clear that the precise orientation of the inner surface 21 does not play a role in the function of the oblique outer surface 20.

In the variation of FIG. 7B, the outer surface is not directed obliquely but the inner ring 10 has a substantially L-shaped cross-section, wherein a proximal end of the outer surface 22*a* is directed substantially axially, while a distal end 23 of the inner ring 10 has a larger outer diameter, so that the axial surface part 22*a* changes into a substantially radially directed surface part 22*c* via a convex part 22*b*. Also in this case, a complementary shaped inner surface of an outer ring can engage the outer surface of the inner ring.

FIG. 7C shows yet another variation, wherein the cross section of the inner ring 10 is circular, with the exception of the oblique outer surface 20. Also in this case, the operation of the oblique outer surface 20 is not affected by the circular contour of the remainder of the surface.

FIG. 8 illustrates a preferred detail of the outer ring 30. For sake of simplicity, the bars 51, 52 and the inner ring 10 are not shown. Because of the symmetry, only half of the outer ring 30 is shown. In the embodiment of FIG. 4, the oblique inner surface 34 extends from the lower surface 32 to an axially directed inner surface 35; in that case, the upper end of the oblique inner surface 34 has a radius corresponding to the smallest inner radius of the outer ring 30. In the case of the embodiment of FIG. 8, the outer ring 30 is, at its upper surface 31, provided with an also annular stop 81 directed inwards, having a lower surface 82 preferably directed substantially parallel to the upper surface 31 and extending between axially directed inner surface 35 and the upper end of the oblique inner surface 34. If, when exerting pressure force on the outer ring 30, the outer ring 30 is radialy pressed somewhat outwards and/or the inner ring 10 is radialy pressed somewhat inwards, this stop 81 offers the advantage that the outer ring 30 can not shoot past the inner ring 10 because the stop 81 comes into contact with the upper side 17 of the inner ring 10. An advantageous secondary effect is that, because of this, the pinching effect between the inner ring 10 and the outer ring 30 is increased.

In the above, the oblique surface parts 20 and 34 cooperating with each other are described as conical, i.e. directed according to a cone surface. In this context, it is not necessary that those surface parts 20 and 34 are completely planar. In a possible embodiment, the surface parts 20 and 34 are provided with projecting ridges and possibly recessed grooves, in order to thus offer an improved hold on the support stocking held between the inner ring 10 and the outer ring 30. In an other possible embodiment, those surface parts 20 and 34 are implemented in a stepped way. FIG. 9 illustrates this embodiment variation on a larger scale. Here, the inner ring 10 and the outer ring 30 are shown in their mutually cooperating positions, shifted into each other. It appears clearly from FIG. 9 that the outer surface 20 of the inner ring 10 is implemented as a series of subsequent segments 90 with mutually different outer diameter, while those outer diameters, seen in the direction from downside to upper side in the figure, increase stepwise. Each segment 90 has an outer surface 91 of which the diameter is substantially constant over the axial dimension of this segment, although it is also possible that this diameter increases gradually, seen in the direction from lower side to upper side in the figure. Further, the stepwise transition between two adjacent segments 90 is formed by an annular surface part 92 directed substantially in the axial direction, although it is also possible that this annular surface parts 92 make an angle unequal to 90° with the axial direction. In the figure, the axial dimensions of the segments 90 are mutually equal, but those axial dimensions may also be mutually different. In the figure, the radial dimensions of the annular surface parts 92 are mutually equal, but those radial dimensions may also be mutually different.

In a comparable manner as described with reference to the inner ring 10, the inner surface 34 of the outer ring 30 is implemented stepwise, wherein the stepped contour of the inner surface 34 of the outer ring 30 corresponds to that of the outer surface 20 of the inner ring 10.

In FIG. 9 it is further shown that the annular stop 81 of the outer ring 30 can be provided with an annular groove 83 directed towards the inner ring 10, and that the inner ring 10 is provided with an annular projection 84 at its proximal end edge 17, fitting in said groove. Hereby, on the one hand a stronger connection is achieved between the inner ring 10 and the outer ring 20, which is particularly important when manoeuvring the assistance device around the ankle, while further a still larger grip on the support stocking is afforded.

If the assistance device 1 is exclusively intended to be used as a stocking take off assistance, the bracket 60 may be omitted. The bracket 60 only serves to be also able to use the assistance device 1 as stocking putting-on aid. In the embodiment of FIG. 1, the bracket 60 comprises a semi-circular bracket part 61, which, at its ends, is connected to the outer ring 30 at a distance by means of two obliquely directed bars 62 and 63 and which is substantially parallel to the outer ring 30. A central, substantially inverted U-shaped support bracket 64 supports a central part of the semi-circular bracket part 61, for increasing the strength. In the preferred embodiment of FIG. 2, the bracket 60 comprises two inverted U-shaped brackets 65, 66 mounted on the upper surface 31 of the outer ring 30 on opposite sides of the wheel assembly 80, with mutually substantially parallel legs and substantially horizontally directed bottom parts.

During use a support stocking is arranged into the inner space of the outer ring 30, wherein an upper end of this support stocking is folded over the upper edge of the bracket 60, and wherein the support stocking is tucked down until the heel of the stocking is at the upper side. As a result, the support stocking is kept open by the bracket 60 at the location of the instep of the foot, so that a user can put his foot into the foot of this support stocking. By pulling the handle grip 50, one gives to the bracket 60 the required counterforce to keep the support stocking in its place, against the pressure force of the leg.

It will be clear to a person skilled in the art that the invention is not limited to the exemplary embodiments discussed in the above but that several variations and modifications are possible within the protective scope of the invention as defined in the attached claims.

For instance, it is possible that the peripheral dimension of the inner ring 10 is smaller then 180°, or is equal to 180°. In that case, it is possible that two of such "semi-lunarshaped" inner ring parts are used opposite to each other in order to together form a fully closed inner ring, wherein each of the "semi-lunarshaped" inner ring parts via a radial displacement can be placed and by turning the upper edge 111 of the stocking 110 can be kept in place.

It is further possible that the oblique outer surface of the inner ring 10 extends over the entire axial dimension of the inner ring 10, but it is also possible that the oblique outer surface of the inner ring 10 extends over only a part of the axial dimension of the inner ring 10. It is also possible that the oblique inner surface 34 of the outer ring 30 extends over the full axial dimension of the outer ring 30, but it is also possible that the oblique inner surface 34 of the outer ring 30 extends over only a part of the axial dimension of the outer ring 30. It is further possible that the oblique outer surface of the inner ring 10 consists of multiple parts with mutually different obliqueness; the same holds through for the oblique inner surface 34 of the outer ring 30. The axial dimensions of those different parts with mutually different obliqueness do not have to be mutually equal.

It is further possible that the outer surface of the inner ring 10 is directed completely axially, or makes an angle with the body axis smaller than the angle which the inner surface of the outer ring makes with the body axis. In that case, the inner surface of the outer ring will only engage the proximal outer edge of the inner ring. Such embodiment will work, but more wear and tear of the stockings may possibly occur.

The invention claimed is:

1. Stocking take-off assistance device (1), suitable as aid for taking off stockings (110), which device comprises:

at least one substantially annular inner device (10), suitable to be arranged around a leg (100) and to receive a turned upper edge (111) of a stocking (110), wherein the annular inner device (10) encompasses an inner space (13);

a substantially annular outer device (30) matching the annular inner device (10), suitable to be arranged around the leg (100) and around the inner device (10), such that an upper edge (111) of a stocking (110) folded back around the annular inner device (10) can be clamped between the annular inner device (10) and the annular outer device (30), wherein the annular outer device (30) encompasses an inner space (36);

wherein:

the annular inner device (10) extends in peripheral direction according to a part of a circle over an angle ($\alpha$) in the range of 215° to 290°, wherein an access opening (14) to the inner space (13) is defined between ends (11, 12) of the annular inner device (10);

the annular outer device (30) extends in peripheral direction according to a part of a circle over an angle ($\beta$) in the range of 215° to 290°, wherein an access opening to the inner space (36) is defined between ends (37, 38) of the annular outer device (30);

the annular inner device (10) has at least one tapered outer surface part (20) while the annular outer device (30) has at least one tapered inner surface part (34), wherein the conic orientation of the inner surface part (34) of the annular outer device (30) corresponds to the conic orientation of the outer surface part (20) of the annular inner device (10);

the annular outer device (30) has an upper surface (31) and a lower surface (32) wherein the radial inner dimension of the annular outer device (30) close to its lower surface (32) is larger than the radial inner dimension of the annular outer device (30) at a position closer to its upper surface (31);

the annular inner surface (10) at a location close to a proximal endplane (15) thereof has a radial outer dimension which is smaller than the radial inner dimension of the annular outer device (30) close to its lower surface (32); and the annular outer device (30) is provided with at least one grip (50) which extends substantially axially in a direction perpendicular to the upper surface (31).

2. Stocking take-off assistance device according to claim 1, wherein the said outer surface part (20) of the inner device (10) is located on a cone surface, wherein the said inner surface part (34) of the outer device (30) is located on a cone surface, and wherein said cone surfaces have mutually equal top angles.

3. Stocking take-off assistance device according to claim 1, wherein the outer surface part (20) of the inner device (10) is provided with projections and/or grooves.

4. Stocking take-off assistance device according to claim 1, wherein the said outer surface part (20) of the inner device (10) and the said inner surface part (34) of the outer device (30) are implemented stepwise.

5. Stocking take-off assistance device according to claim 4, wherein the outer surface part (20) of the inner device (10) is implemented as a series of subsequent cylindrical outer surface parts (91) with mutually different outer diameters, separated from each other by respective annular service parts (92) directed substantially perpendicular to the axial direction; and wherein the inner surface part (34) of the outer device (30) has a corresponding shape.

6. Stocking take-off assistance device according to claim 1, wherein the annular inner device (10) has a radial outer dimension larger than the radial inner dimension of the annular outer device (30) close to its upper surface (31).

7. Stocking take-off assistance device according to claim 6, wherein said radial outer dimension is achieved at an axial position which is located at a distance from the said proximal end plane (15).

8. Stocking take-off assistance device according to claim 1, wherein the grip (50) is curved, and wherein the concave side of this curve is located at the side of the free ends (37, 38) of the annular outer device (30).

9. Stocking take-off assistance device according to claim 1, wherein the annular outer device (30) is provided with at least one span bracket (60) for spanning the end (111) of a stocking (110) for the purpose of putting the stocking on.

10. Stocking take-off assistance device according to claim 1, wherein the annular outer device (30) is provided with a support wheel or support roller (80) at a central position with respect to its free ends (37, 38).

11. Stocking take-off assistance device according to claim 1, wherein the annular outer device (30) at its upper surface (31) is provided with a stop (81) directed inwards, which has a lower surface (82) directed substantially parallel to the upper surface (31).

12. Stocking take-off assistance device according to claim 1, wherein the annular outer device (30) at its upper surface (31) is provided with a stop (81) directed inwards with an annular groove (83) directed towards the annular inner device (10), and wherein the annular inner device (10) is provided with a projection (84) fitting a said groove (83).

13. Stocking take-off assistance device according to claim 1, wherein the inner surface part (34) of the outer device (30) is provided with projections and/or grooves.

14. Stocking take-off assistance device according to claim 7, wherein said radial outer dimension is achieved at an axial position which is located close to the opposite distal end plane (16).

15. Stocking take-off assistance device according to claim 1, wherein the stocking (110) comprises an elastic support stocking.

* * * * *